US006306023B1

(12) United States Patent
Gmeilbauer

(10) Patent No.: US 6,306,023 B1
(45) Date of Patent: Oct. 23, 2001

(54) GRINDING TOOL, SPECIALLY FOR HAND-HELD OSCILLATING DEVICES

(76) Inventor: Engelbert Gmeilbauer, Stocketweg 1, Seefeld D-82229 (DE)

( * ) Notice: Subject to any disclaimer, the term of this patent is extended or adjusted under 35 U.S.C. 154(b) by 0 days.

(21) Appl. No.: 09/445,155

(22) PCT Filed: Jun. 5, 1998

(86) PCT No.: PCT/DE98/01530

§ 371 Date: Jan. 26, 2000

§ 102(e) Date: Jan. 26, 2000

(87) PCT Pub. No.: WO98/55266

PCT Pub. Date: Dec. 10, 1998

(30) Foreign Application Priority Data

Jun. 6, 1997 (DE) ..... 197 23 987

(51) Int. Cl.[7] ..... B24B 23/00

(52) U.S. Cl. ..... 451/357; 451/344; 451/358; 451/359

(58) Field of Search ..... 451/344, 357, 451/358, 359

(56) References Cited

U.S. PATENT DOCUMENTS 4,523,411 * 6/1985 Freerks ..... 451/357
4,624,078 * 11/1986 Van Rijen et al. ..... 451/344
5,123,216 * 6/1992 Kloss et al. ..... 451/344
5,637,034 * 6/1997 Everts et al. ..... 451/344

FOREIGN PATENT DOCUMENTS 94 10 754.8 11/1994 (DE) .

OTHER PUBLICATIONS

Brochure entitled "Feinschleifer plus. Feinschleifer accu plus." Taken from Fein Werkzeug von Beruf, 11 pp.

* cited by examiner

*Primary Examiner*—Joseph J. Hail, III
*Assistant Examiner*—Shantese McDonald
(74) *Attorney, Agent, or Firm*—Cohen. Pontani. Lieberman & Pavane

(57) ABSTRACT

The tool body of the grinding tool consists of a holder for fixing the tool to the oscillating device and a flange of relatively soft, flexible material fixed thereto, supporting the abrasive paper and designed or arranged with axial dimensional flexibility at its outer edge. This results in the advantage that, in particular, increased pressure via the tool edge on the grinding surface is avoided. Very soft and very fine work can thus be carried out, so that when grinding or polishing, for example, an unsatisfactory new finish the defects can be perfectly eliminated by the grinding tool according to the invention and, under these circumstances, the peripheral edge of the tool does not act rigidly on the finish, leaving traces behind.

20 Claims, 1 Drawing Sheet

GRINDING TOOL, SPECIALLY FOR HAND-HELD OSCILLATING DEVICES

BACKGROUND OF THE INVENTION

1. Field of the Invention

The invention relates to a grinding tool, especially for hand-held oscillating devices as used, for example, for fine grinding work such as the abrasive treatment of new automobile finishes.

2. Discussion of the Prior Art

It is known that with new finishes it is unfortunately not always possible to prevent contaminating particles from falling into the fresh paint or the occurrence of other forms of contamination and irregularities or finish runs.

To eliminate these finishing errors, a tool has previously been used which consists of a cylindrical plastic block of about 3 cm diameter, to whose underside flat abrasive paper is stuck by means of an adhesive strip. The treatment is then carried out manually and is extremely laborious and, very often, unsatisfactory in its results.

Grinding tools are admittedly known which are used together with hand-held oscillating devices (see, for example, German reference DE 94 10 754.8 A1 and the Fein company's brochure "Feinschleifer plus"8.96). These known grinding tools each have relatively rigid grinding disks, on the undersides of which abrasive sheets can be stuck. The overall treatment surface of the tool is consistently of equal hardness or rigidity, up to the outer edge, so that a particularly sensitive, soft, enhancing regrinding and polishing operation cannot be undertaken sufficiently optimally. In addition, these tools are rigidly arranged on the oscillating device in question and have a predetermined working surface orientation extending parallel to the oscillating device, as a result of which problems may arise in confined spaces.

SUMMARY OF THE INVENTION

The object of the present invention is to provide a grinding tool of the generic type named above whereby very accurate and fine grinding work, especially the after-treatment of finishing errors, can be optimally undertaken.

According to the invention, the tool body of the grinding tool consists of a holder for fixing the tool to the oscillating device and a flange of relatively soft, flexible material fixed thereto, supporting the abrasive paper and designed or arranged with axial dimensional flexibility at its outer edge. This results in the advantage that, in particular, increased pressure via the tool edge on the grinding surface is avoided. Very soft and very fine work can thus be carried out, so that when grinding or polishing, for example, an unsatisfactory new finish the defects can be perfectly eliminated by the grinding tool according to the invention and, under these circumstances, the peripheral edge of the tool does not act rigidly on the finish, leaving traces behind.

The axial dimensional flexibility of the flange is achieved, according to the invention, in that the supporting surface of the flange on the holder is much smaller than the working surface of the flange. As a result, a projecting flange part exists which yields with corresponding elasticity and is bent softly downwards under axial compressive stress at the edges.

It is advantageous for the flange to consist of soft rubber or soft plastic, while the holder is produced from rigid plastic. In this case, the holder and the flange can, for example, be firmly adhesively bonded to one another.

However, the possibility also exists of connecting flange and holder to one another releasably, for example via a touch-and-close arrangement or adhesive tape, which permits the advantage of rapid replacement potential in the event of failure of one of the two parts or the use of different flanges in conjunction with the same mounting, which can prove very cost-effective.

It is particularly advantageous if the holder is also designed as a joint, forming a bearing block, which supports the flange on one of its end faces and supports a pivot member (joint head) pivotably mounted in the block via a joint pivot pin on its other side, preferably in a corresponding axial recess, via which pivot member the tool is fixed to the oscillating device. The advantage of additional angular adjustment is thus-provided here, in other words the active surface of the tool bearing the abrasive paper is adjustable in angle or in its inclination relative to the oscillating device, so that optimum handling with an optimum working effect is possible even on restricted working surfaces of difficult access. Instead of a simple joint with a single pivot pin it is of course also possible to provide a two-pin joint whose two pivot pins stand perpendicularly relative to one another, so that the inclination of the active tool surface can be designed as desired, which is very advantageous with regard to handling and working result.

It is further advantageous if the holder is of essentially cylindrical design, at least on the flange side, and is arranged with its axis standing perpendicularly on the flange, and if it has markedly rounded edges on the side facing the flange. As a result, therefore, a high degree of axial dimensional flexibility can be achieved in the peripheral zone of the active surface by a flange which is designed as a cylindrical disk arranged concentrically with the holder, the holder and flange having essentially equal diameters. With somewhat heavier axial pressure on the edge or the outer edge section, this outer flange part will yield elastically axially, while its central part is firmly connected, for example bonded, to the holder. Depending on the size of the rounding, stepping or chamfering of the holder, the flexibility of the flange will also be different.

In a further embodiment, the flange may be designed in the form of a truncated pyramid with a cross-sectional tapering toward the holder. In this arrangement, the diameters of the end faces, facing one another or resting on one another, of the flange and holder are essentially the same, so that the holder sits flush on the small base surface of the conical flange. As a result, the flange projects outward in the manner of a skirt or widens toward the working surface from the holder. As a result, the flange is firmly supported axially only in respect of the part of the surface covered by the holder, the small base surface, while the (spacer) ring extending to the outer edge of the lower, large base surface has a high axial elasticity as a result of its cross-sectional tapering so that very precise, soft treatment is possible.

In a further, advantageous embodiment an essentially cylindrical support disk is arranged between holder and conical flange, its diameter being greater than the outer diameter of the holder and at the same time of equal size with the small base of the conical flange. As a result of the relatively large support disk, which may likewise be produced from the same material as the holder, in other words rigid plastic, the holder may first have any desired outer peripheral shape, in other words cylindrical, rectangular, square or polygonal. In addition, which is extremely advantageous, a polishing cover which is designed in the form of a pot-shaped hood, can be drawn over the rubber flange and the support disk, it being possible for this polishing cover to be a sheepskin. With only a few movements of the hands, therefore, a grinding disk can be converted into a polishing disk with extremely good properties by pulling on the sheepskin hood.

The design of the support disk with a large diameter also represents a relatively large grinding or working surface, which is of great advantage, especially, for the treatment of relatively large, flat surfaces. A flange with a cylindrical generated surface may, of course, also be used in the design with the support disk, provided that the support disk has a working surface of smaller diameter as a result of rounding, stepping or discontinuous edges or, very simply, as a result of the outer diameter of the disk being correspondingly smaller relative to the flange.

In this arrangement, either the support disk can be designed integrally with the holder or the support disk and holder can be two separately prepared parts which are fixedly connected to one another, for example via axially guided screws or permanent adhesive bonding, or can be releasably connected to one another via adhesive strips or a touch-and-close fastening. Simultaneously, in the case of the releasable design, the soft flange can be releasably bonded to the support disk so that, especially for storage of this grinding attachment, only one holder need be provided in each case, on which, for example via touch-and-close fastenings, a plurality of differently designed flanges with support disks fixed thereto can be made available for modular assembly in different designs and sizes.

Instead of the tool which is designed with symmetry of rotation (cylindrical or conical), it is of course also possible to use a polyhedral design. Thus, for example, the holder may be of square cross section, while the support disk (which in this case is a support plate) with flange may be, for example, of triangular or hexagonal design.

To minimize the floating tendency of the tool, it is advantageous if a positional fixing of the joint or of the active working side of the tool is possible, this being achieved in a manner known per se by a stiff bearing construction, the arrangement of set-screws or the provision of devices such as bullet catches or pin catches.

It is known that, customarily, additional grinding agents, polishing agents, water or soap suds are used for grinding. In the use of conventional tools, additional grinding and cooling agents need to be applied to the tool or the surface to be treated in advance or repeatedly from separate containers. According to the invention, the possibility now exists of introducing these additional treatment agents as required, continuously and selectively, directly at the point of action through a feedline passed axially through the tool body and opening onto the active working surface. The agent can be conveniently fed by means of a bellows-like container which can be filled with the liquid in question and is connected via the hose of the grinding tool. As a result, more efficient working is possible, especially with relatively large surfaces to be treated.

The container receiving the additional liquid agent, which may be designed as a bellows or alternatively in the form of a simple elastic balloon, can be designed to be replaceable or refillable, in other words the elastic container may be fixedly connected to the hose and filled through a closable aperture. It may also, however, be connected to the hose by, for example, a screw connection and in addition replaced as needed in the manner of a prefabricated or previously prepared, filled cartridge.

The arrangement of the container may also be undertaken in different ways. Thus, the container may be freely suspended on a relatively long feed hose so that its actuation can be undertaken with the hand which is free during treatment. However, the possibility also exists of fixing the bellows to the oscillating device via measures which are known per se, such as clips, so that the pumping movements accordingly required can be performed by one of the fingers of the hand supporting the oscillating device. It is also conceivable to accommodate or integrate the bellows dimensionally in the device housing so that only a membrane-like pressure surface or a mere part of the container is visible.

The size of the grinding tool or grinding attachment varies in accordance with the possible diametral sizes of the grinding surfaces (from 2 to 19 cm in 1 cm steps). The abrasive paper used is usually round, with a bent-over edge and provided with adhesive strips, so that the grinding attachments can be fitted therewith. The grain of the abrasive paper may vary from very fine to coarse, depending on requirements.

BRIEF DESCRIPTION OF THE DRAWINGS

The invention is described in detail below with reference to a plurality of examples of embodiments and to the drawings, in which.

DETAILED DESCRIPTION OF THE PREFERRED EMBODIMENTS

Figure 1:
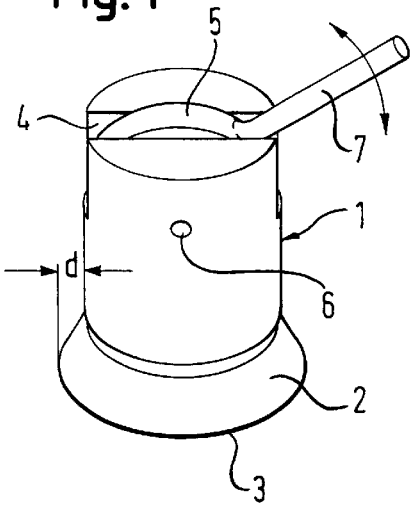
FIG. 1 shows a perspective view of a grinding tool according to the invention in a first embodiment, with a small conical flange.

The first embodiment of the grinding tool according to the invention, shown in FIG. 1, consists of a cylindrical holder 1, to one of whose end faces, in this case the lower one, a conical flange 2 is attached so that its circumference increases toward the bottom, conically or in the manner of a skirt, so that an annular, free flange enlargement of width "d" exists. The free end surface of the flange 2 is fitted with an abrasive paper 3 known per se, this fitting being by means of adhesive strips or touch-and close devices so that the abrasive papers can be replaced. Thus, as is generally known with grinding tools, this abrasive paper 3, also referred to as a flower or trefoil, can be easily and quickly replaced as necessary. The holder 1 is designed as a joint and possesses in its upper end face, opposite to the active working surface, an axial slit 4 in which a flat joint head 5 is pivotably arranged by means of a joint pivot pin 6 guided radially through within the holder 1. The joint head 5 is either fixed directly to a drive shaft 7 of an oscillating device or fixed by means of a rod 7 in an oscillating body mounting known per se (see DE 195 31 270 A1), which for its part is fixedly seated on the oscillator shaft.

Figure 2:
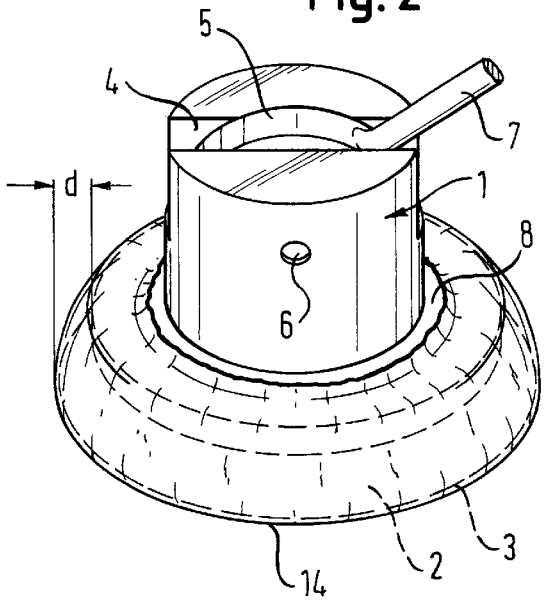
FIG. 2 shows a perspective view, as in FIG. 1, of a second embodiment of a grinding tool with a large conical flange and a support disk.

The embodiment shown in FIG. 2 possesses a holder 1 which is designed in the same manner as that in the example of embodiment according to FIG. 1, specifically as a joint. On its underside it bears a cylindrical support disk 8 which has a larger diameter than the holder 1 and to whose lower end face a flange 2 of soft material, such as soft rubber or soft plastic, is fixed.

Figure 3:
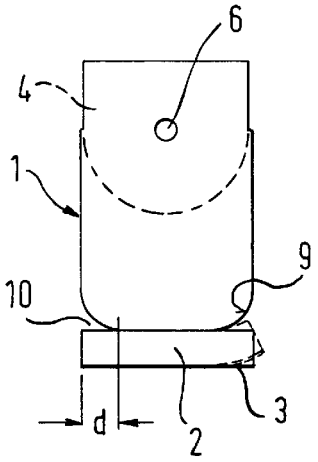
FIGS. 3 to 5 show three views, specifically two lateral views and one plan view, of a third embodiment of a grinding tool with a cylindrical flange and a rounded holder edge.
Figure 4:
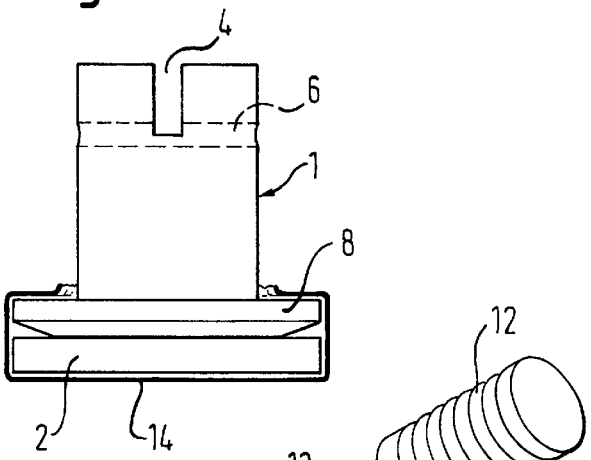
Figure 5:
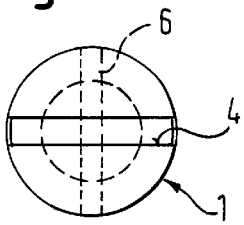

In the further embodiment shown in FIGS. 3 to 5 a cylindrical holder 1' designed as a joint is likewise provided, but in this case possesses a marked rounding 9 of its edge at its lower end face. In this embodiment, the flange 2' is designed as a cylindrical disk, whose outer diameter is approximately equal to the outer diameter of the holder 1'. A gap 10 is formed by the edge rounding 9 between the holder 1' and the flange 2', and permits backward yielding of the peripheral zone of width "d" of the flange 2' during use. Especially when a working pressure is exerted on the lower flange edge, therefore, the possibility exists of this section "d" being elastically pressed into the gap 10, as a result of which particularly sensitive working is possible. As is indicated in broken lines in FIG. 4, an edge chamfering (left) or an edge stepping (right) may be provided instead of an edge rounding in order to obtain the distance "d" or a gap 10 which permits an adequate axial deformability or elastic bending potential of the flange edge.

FIG. 5 shows how the joint slit 4 and the joint pivot pin 6 are arranged in the holder 1.

Figure 6:
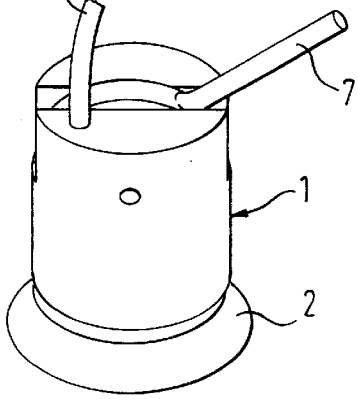
FIG. 6 shows a perspective view of a grinding tool according to FIG. 1 with a container and a feed hose for additives.

FIG. 6 shows how a feed hose 11 axially introduced into the holder 1 and terminating in an axial feed line or drilled hole (not shown) opening into the grinding surface is additionally attached to the tool according to FIG. 1. The hose 11 bears a container 12 at its other end, which in this case is designed to have axial elasticity of compression in the manner of a bellows. The connection between the feed hose 11 and the container 12 is here produced by means of a cap-shaped screw connection 13, this screw connection being fixedly attached to the hose 11, while the container 12 is a screw-topped bottle with a bellows body.

A grinding or polishing cover 14 can be placed over the flange 2 in the manner of a hood.

What is claimed is:

1. A grinding tool, for a hand-held oscillating device, comprising:

a tool body which is attachable to the oscillating device and has an active side on which abrasive paper is replaceably fixed, the tool body consisting of a holder for fixing to the oscillating device, and a flange of soft, flexible material supporting the abrasive paper, the flange being coaxial with the holder and having an outer edge that extends beyond a supporting surface of the holder for the flange with axial dimensional flexibility, the holder being configured as a joint having a bearing block which supports the flange, a joint head pivot member fixable to the oscillating device, and a joint pin arranged to connect the pivot member to the bearing block.

2. A grinding tool as defined in claim 1, wherein the flange is made of one of soft rubber and soft plastic and wherein the holder is made of rigid plastic.

3. A grinding tool as defined in claim 1, wherein the joint head of the holder joint is a flat eye through which the pivot pin passes, the bearing block having a slit-shaped recess in which the joint head is arranged and through which the pivot pin correspondingly passes.

4. A grinding tool as defined in claim 1, and further comprising means for fixedly positioning the joint steplessly.

5. A grinding tool as defined in claim 1, and further comprising a grinding or polishing cover placeable over the flange in a manner of a hood so as to extend over the flange.

6. A grinding tool as defined in claim 1, wherein the abrasive paper can be drawn over the edges of the soft flange and releasably attached to the flange via adhesive strips or touch-and-close measures.

7. A grinding tool as defined in claim 1, and further comprising means for fixedly positioning the joint at particular angles.

8. A grinding tool, for a hand-held oscillating device, comprising:

a tool body which is attachable to the oscillating device and has an active side on which abrasive paper is replaceably fixed, the tool body consisting of a holder for fixing to the oscillating device, and a flange of soft, flexible material supporting the abrasive paper, the flange being coaxial with the holder and having an outer edge that extends beyond a supporting surface on the holder for the flange with axial dimensional flexibility, the holder being essentially cylindrical at least on the flange side, and being arranged with its axis standing perpendicularly on the flange, the holder being diametrically recessed on a side facing the flange.

9. A grinding tool as defined in claim 8, wherein the recess of the holder is formed by one of a rounding of edges of the holder, a chamfering of the edges, and a diametrical step.

10. A grinding tool, for a hand-held oscillating device, comprising:

a tool body which is attachable to the oscillating device and has an active side on which abrasive paper is replaceably fixed, the tool body consisting of a holder for fixing to the oscillating device, and a flange of soft, flexible material supporting the abrasive paper, the flange being coaxial with the holder and having an outer edge that extends beyond a supporting surface of the holder for the flange with axial dimensional flexibility, the flange being a cylindrical disk arranged concentrically to the holder.

11. A grinding tool as defined in claim 10, wherein the holder and the flange are of substantially equal diameter.

12. A grinding tool as defined in claim 10, wherein the flange has a larger diameter than the holder.

13. A grinding tool, for a hand-held oscillating device, comprising:

a tool body which is attachable to the oscillating device and has an active side on which abrasive paper is replaceably fixed, the tool body consisting of a holder for fixing to the oscillating device, and a flange of soft, flexible material supporting the abrasive paper, the flange being coaxial with the holder and having an outer edge that extends beyond a supporting surface of the holder for the flange with axial dimensional flexibility, the flange being formed as a truncated pyramid that tapers toward the holder, an end surface of the holder being of equal size with a small base surface of the flange which rests on it; and a cylindrical supporting disk arranged between the holder and the flange, the supporting disk having a diameter that is greater than an outer diameter of the holder and of equal size to the small base of the flange.

14. A grinding tool as defined in claim 13, wherein the support disk is integral with holder.

15. A grinding tool as defined in claim 13, wherein the support disk is detachably connected to the holder.

16. A grinding tool, for a hand-held oscillating device, comprising:

a tool body which is attachable to the oscillating device and has an active side on which abrasive paper is replaceably fixed, the tool body consisting of a holder for fixing to the oscillating device, and a flange of soft, flexible material supporting the abrasive paper, the flange being coaxial with the holder and having an outer edge that extends beyond a supporting surface of the holder with axial dimensional flexibility;

a feed line provided axially through the holder and the flange so as to open toward the working surface to permit feeding of processing additives; and a container and a flexible feed hose arranged to connect the feed line to the container, the container being one of replaceable and refillable, and one of having elastic walls and being axially compressible as a bellows for selective and positional release of the additive.

17. A grinding tool as defined in claim 16, wherein the container is fixable on the holder within a range of a corresponding actuation finger of a user.

18. A grinding tool as defined in claim 16, wherein the feed hose that connects the container to the holder is relatively long so that actuation by a free, second hand of a user which does not hold the oscillating device is possible.

19. A grinding tool as defined in claim 16, and further comprising a leaktight fast-action closure that releasably connects the container to the hose.

20. A grinding tool as defined in claim 19, wherein the fast-action closure is a screw closure that includes a threaded portion on the container and a screw-on cover attached to the end of the hose, which screw-on cover is threadable on the container.

* * * * *